US009528249B2

(12) United States Patent
Gompper

(10) Patent No.: US 9,528,249 B2
(45) Date of Patent: Dec. 27, 2016

(54) VALVE ASSEMBLY

(71) Applicant: Brion Gompper, Lakewood, NJ (US)

(72) Inventor: Brion Gompper, Lakewood, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 833 days.

(21) Appl. No.: 13/766,381

(22) Filed: Feb. 13, 2013

(65) Prior Publication Data

US 2014/0224351 A1 Aug. 14, 2014

(51) Int. Cl.
*E03C 1/04* (2006.01)
*E03C 1/05* (2006.01)

(52) U.S. Cl.
CPC ..... *E03C 1/04* (2013.01); *E03C 1/055* (2013.01); *Y10T 137/2499* (2015.04)

(58) Field of Classification Search
CPC ..... E03C 1/041; E03C 1/048; E03C 1/055; E03C 2201/30; F16K 11/24; F16K 19/006; F16K 31/002; F16K 31/06; F16K 31/0603; G05D 23/1313; G05D 23/1393
USPC ..... 137/118.02, 118.04, 468, 486, 487.5,137/562, 594, 597, 624.11, 88, 101.19, 115.03,137/115.04, 18.02; 236/12.11–12.15; 4/639, 4/642, 675, 676, 678, 668; 251/129.08, 251/129.15, 129.22; 141/302
See application file for complete search history.

(56) References Cited

U.S. PATENT DOCUMENTS 1,232,855 A * 7/1917 Schoonover ..... F16L 39/00 285/122.1
1,741,606 A * 12/1929 Bean ..... E03C 1/18 4/642
4,429,422 A * 2/1984 Wareham ..... F16K 19/00 137/114
5,358,177 A * 10/1994 Cashmore ..... G05D 23/1393 137/332
7,040,542 B2 * 5/2006 Hugger ..... G05D 23/1393 236/12.12
7,766,026 B2 * 8/2010 Boey ..... E03C 1/057 137/1
2003/0196706 A1 * 10/2003 Parsons ..... E03C 1/057 137/595
2006/0138246 A1 * 6/2006 Stowe ..... E03C 1/05 236/12.12
2010/0078491 A1 * 4/2010 Aoyagi ..... G05D 23/1393 236/12.14
2011/0303311 A1 * 12/2011 Klicpera ..... B05B 12/008 137/551

* cited by examiner

*Primary Examiner* — Paul R Durand
*Assistant Examiner* — Nicholas Ros
(74) *Attorney, Agent, or Firm* — Francis C. Hand; Carella, Byrne, Et Al

(57) ABSTRACT

The valve assembly employs a remotely located button to open normally closed solenoid valves in the cold water line and hot water line via an electronic control module. In response to a second signal from the button, the control module causes the solenoid valves to close. A metering valve senses the flow rate of cold water and issues a signal in response to the flow rate being below a minimum flow rate to the control module to close the solenoid valves to block further delivery of water.

8 Claims, 2 Drawing Sheets

VALVE ASSEMBLY

This invention relates to a valve assembly. More particularly, this invention relates to a valve assembly for monitoring water delivered to a commercial sink.

As is known, commercial kitchens have sinks of many types that are used for various purposes in the preparation of food for consumption by the general public. For example, sinks have been constructed in a cascade manner with two or more bowls wherein one bowl is sized to empty into an adjacent bowl by an overflow of water from the one bowl to the other bowl.

It has also been known that cascade type sinks have been used for preparing foods wherein a first bowl is filled with running water for purposes of soaking a foodstuff or of rinsing a foodstuff for a determined amount of time before the food is delivered into the second bowl. One of the problems associated with the preparation of foods in this manner is that the presence of a user is required to monitor the flow of water into the first bowl through the faucets of the sink in order to insure that a proper mixture of hot water and cold water is delivered to the bowl for the desired food preparation procedure.

In addition, one of the problems in a commercial kitchen is that personnel turn on the water delivered to a sink for a rinse cycle, and then move throughout the kitchen completing other tasks while water continues to run. As a result, there is a waste of water.

Accordingly, it is an object of the invention to be able to automatically monitor the delivery of hot and cold water to a commercial sink.

It is another object of the invention to reduce the expense of preparing foods in a commercial kitchen.

It is another object of the invention to eliminate the need for a person to be present at a sink during water rinse in a commercial kitchen.

It is another object of the invention to ensure that a consistently proper volume of water is dispensed for rinse purposes in a commercial kitchen.

It is another object of the invention to reduce the risk that hot water only would not be supplied to a sink in a commercial kitchen.

It is another object of the invention to be able to both retro-fit existing kitchens and to provide new installations without revision to existing faucet and pre-rinse assemblies in a commercial kitchen.

It is another object of the invention to ensure quality and consistency of a rinse cycle through controlled time and water volume and to ensure water conservation by eliminating waste due to the absence of personnel at a sink while water continued to flow.

Briefly, the invention provides a valve assembly that can be retro-fitted to existing sinks of a commercial kitchen in order to control the flow of water into a sink, particularly, a cascade type sink having multiple bowls arranged in side-by-side manner.

The valve assembly is constructed to operate in an automatic manner to allow the delivery of both a flow of cold water and a flow of hot water for a predetermined time period (i.e. a set time cycle) while preventing a flow of hot water should the delivery of cold water be interrupted or reduced below a predetermined level.

The valve assembly is constructed to be operated in a remote manner so that a user need not be stationed at a sink. This allows personnel to initiate delivery of water to a sink for a rinse cycle, and then move throughout a kitchen completing other tasks while water runs for the set time cycle and then shuts off automatically.

The valve assembly includes a housing having a cold water inlet, a hot water inlet, a cold water outlet in communication with said cold water inlet and a hot water outlet in communication with said hot water inlet. The housing is sized to be incorporated in a pair of water supply lines for delivering hot and cold water to the faucets (i.e. taps) of the sink and may be mounted under the sink in any suitable manner. In addition, the valve assembly includes and a normally closed solenoid valve in communication with the cold water outlet for closing off the flow of water therefrom and a second normally closed solenoid valve in communication with the hot water outlet for closing off the flow of water therefrom.

The valve assembly also has a flow metering valve in communication with the cold water outlet for sensing the flow of cold water from cold water outlet and is set to a minimum flow rate. If the minimum flow rate is not achieved, a responsive signal is generated.

The valve assembly includes an electronic control module that is electrically connected to the metering valve and the two solenoid valves as well as a button that is electrically connected to the electronic control module. The button is located remotely from the electronic control module as well as the sink to allow actuation by a user without a need to be present at the sink.

The button of the valve assembly has an OFF position and an ON position and is manually movable from the OFF position to the ON position.

The electronic control module is programmed to receive a signal from the button upon the button being moved from the OFF position to the ON position and to deliver responsive signals to the solenoid valves to open allowing hot water and cold water to flow to the faucets of a sink for a predetermined time period (set time cycle).

The electronic control module is also programmed to receive a signal from the button upon the button being moved a second time from the OFF position to the ON position during the predetermined time period to close the solenoid valves in both the hot water line and cold water line in order to block the flow of water to the sink. This allows a user to override the delivery of water.

During delivery of water, should the metering valve metering the flow of cold water sense that the cold water flow is below a predetermined level, a signal is delivered to the electronic control module indicative of such. The electronic control module, in turn, is programmed to respond to the signal by sending signals to the solenoid valves to close and thereby block the flow of hot water and cold water.

The metering valve on the cold water side provides a safety feature to guard against the possibility that only hot water is supplied to a sink that could otherwise cause injury to personnel operating the sink. Typically, the sink has manual valves at the faucet and pre-rinse assemblies of the sink.

The valve assembly is also provided with a normally closed manually operable valve in communication with the cold water outlet for controlling the flow of water therefrom. This manual valve has but one function. In the event the electronic control module malfunctions, kitchen personnel can disconnect the power supply to the control module and manually rotate the valve to an open position. The valve will thus by-pass the control circuit and allow the flow of cold water only. No hot water will be allowed to flow. This ensures that the cold water rinse would always be available to the sink.

These and other objects and advantages of the invention will become more apparent from the following detailed description taken in conjunction with the accompanying drawings wherein.

Figure 1:
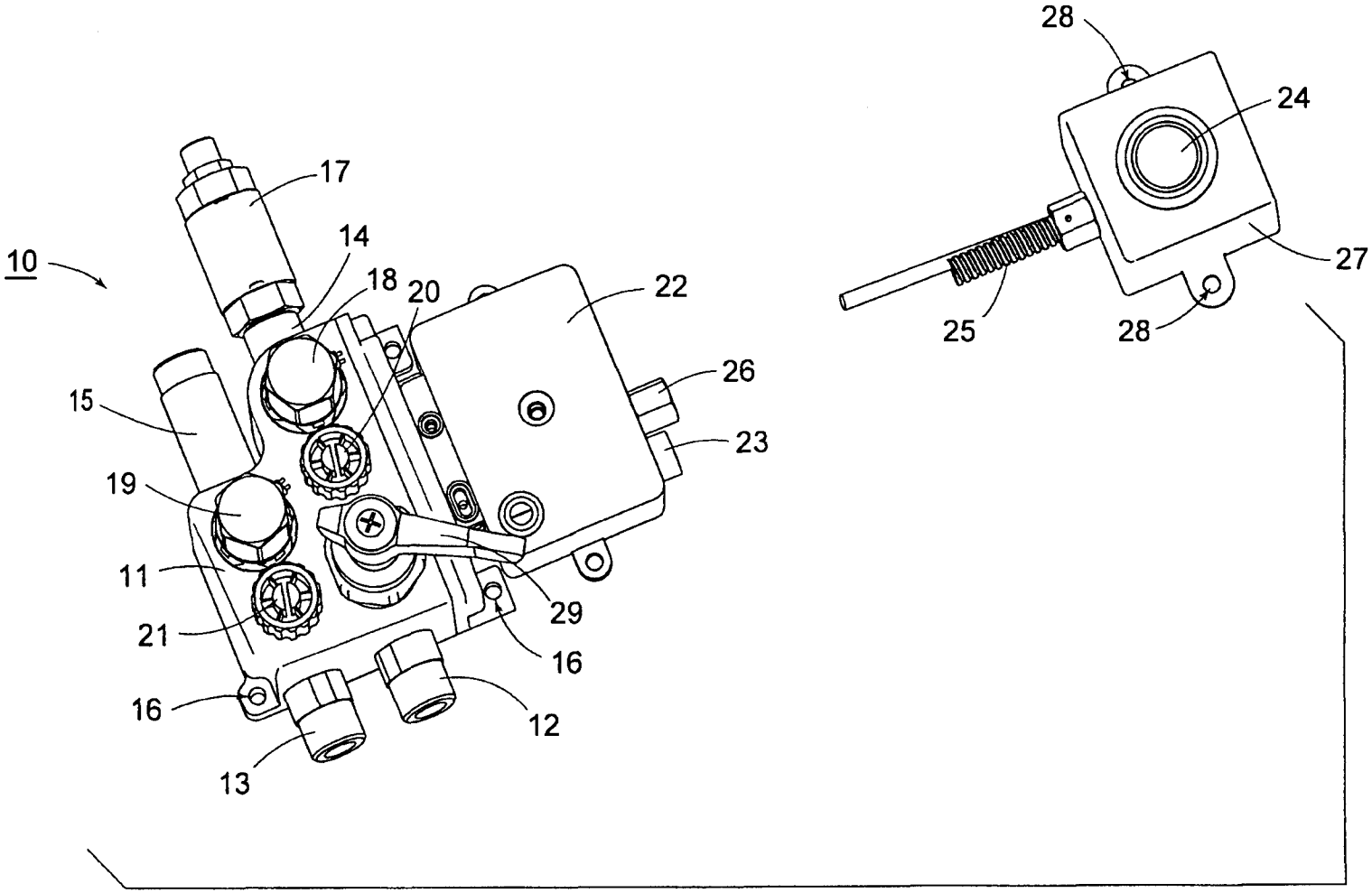
FIG. 1 illustrates an exploded view of a valve assembly in accordance with the invention.

Referring to FIG. 1, the valve assembly 10 comprises a housing 11 having a cold water inlet 12, a hot water inlet 13, a cold water outlet 14 in communication with the cold water inlet 12 and a hot water outlet 15 in communication with the hot water inlet 13.

The housing 11 is of compact construction and is sized to be retrofitted into the cold water and hot water supply lines (not shown) that supply water to a sink. As illustrated, the housing 11 has apertured ears 16 at the corners to allow for mounting by screws or the like on a wall or the like along which the supply lines extend.

The valve assembly 10 also has a flow metering valve 17 in communication with the cold water outlet 14 for sensing the flow of cold water from the cold water outlet 14, a first normally closed solenoid valve 18 in communication with the cold water outlet 14 for closing off the flow of water therefrom, and a second normally closed solenoid valve 19 in communication with the hot water outlet 15 for closing off the flow of water therefrom.

The valve assembly 10 also has a filter 20 in the housing 11 between the cold water inlet 14 and the first solenoid valve 18 for filtering cold water passing to the solenoid valve 18 as well as a like filter 21 in the housing 11 between the hot water inlet 13 and the solenoid valve 19 for filtering hot water passing to the solenoid valve 19.

The valve assembly 10 also has an electronic control module 22 mounted on the side of the housing 11 that is electrically connected to the metering valve 17 and to each solenoid valve 18, 19. By way of example, a multi-line cable (not shown) extends from an output 23 of the control module 22 with one line extending to the metering valve 17 and separate lines extending to each of the solenoid valves 18, 19. The control module 22 is programmed in a suitable manner to perform the functions described below.

The valve assembly 10 also has a button 24 that is electrically connected to the control module 22 from a remote location via an umbilical cord 25, for example, having a wire encased in a metal jacket. As illustrated, the umbilical cord 25 is electrically connectable to an input 26 on the control module 22 in order to deliver actuating signals thereto.

The button 24 has an OFF position and an ON position and is manually movable from the OFF position to the ON position. As illustrated, the button 24 is disposed in a separate housing 27 provided with a pair of aperture ears 28 for mounting on a suitable support (not shown) located remotely from the control module 22. The button 24 is also biased by a spring (not shown) to return from the ON position to the OFF position upon being manually released.

In operation, when a user depresses the button 24 from the OFF position to the ON position, an actuation signal is delivered to the control module 22.

The control module 22 is programmed so that, in response to the button 24 being moved to the ON position, the control module 22 causes each solenoid valve 18, 19 to open for a predetermined time period (i.e. a filling cycle) to allow a flow of water from each of the cold water outlet 14 and hot water outlet 15 to the sink (not shown). The valve assembly 10 is thus able to automatically deliver a predetermined quantity of cold water and hot water over a predetermined time before shutting off the flow of water.

The control module 22 is also programmed to receive a signal from the metering valve 17 in response to the sensed flow of cold water during the filling cycle be below the programmed minimum flow rate. Upon reception of such a signal, the control module 22 delivers signals to the two solenoid valves 18, 19 to close and thereby block the flow of hot water and cold water to the sink.

The control module 22 is also programmed so that, in response to the button 24 being moved to the ON position a second time during the predetermined time period, signals are delivered to the two solenoid valves 18, 19 to close and thereby block the flow of hot water and cold water to the sink.

In order to allow a by-passing of the electronic control module 22, a normally closed manually operable valve 29 is mounted on the housing 11 in communication with the cold water outlet 14. As illustrated, the manually operable valve 29 is disposed upstream of the filter 20 and between the filter 20 and the cold water inlet 12. In addition, the manually operable valve 29 is in parallel with the normally closed solenoid valve 18 relative to the flow of cold water.

In the event that the electronic control module 22 malfunctions, or the kitchen personnel wish to bypass the control module 22, the manually operated valve 29 may be opened to allow only cold water to flow to the sink since the normally closed solenoid valves 18, 19 are closed thereby blocking the flow of hot water. Thus, the hot water will not be allowed to flow, and the cold water will be by-passed and flow to the sink. This ensure cold rinse water availability in the event the control module 22 control malfunctioned and ceased operation.

Figure 2:
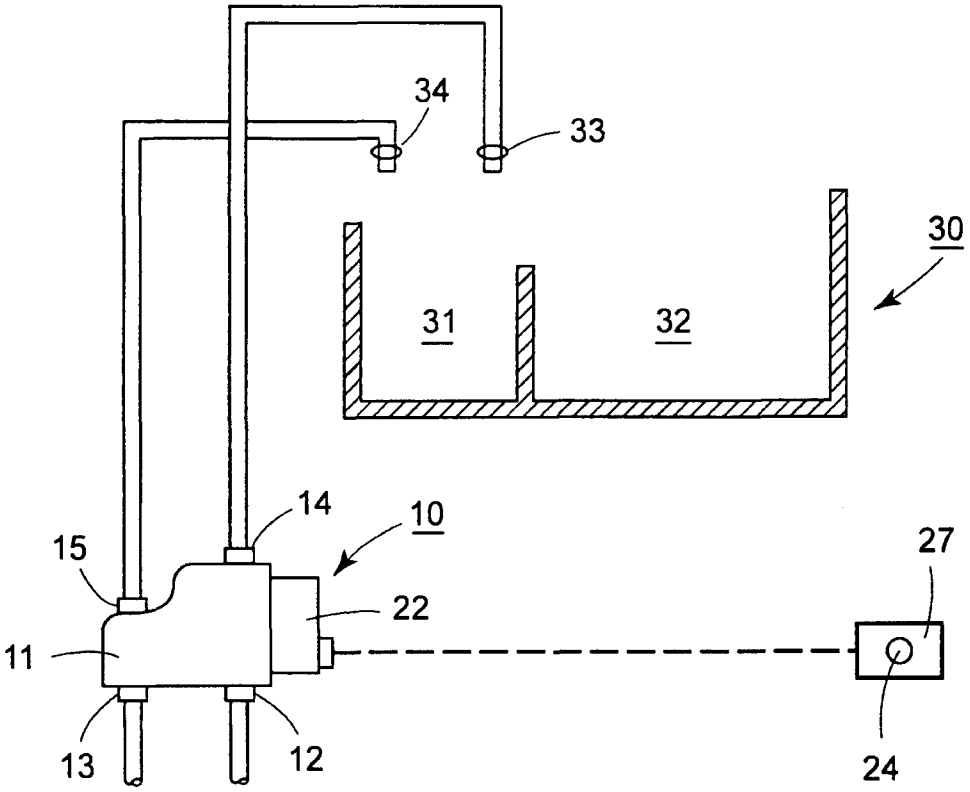
FIG. 2 illustrates a schematic view of a sink of a cascade type employing the valve assembly of FIG. 1.

Referring to FIG. 2, wherein like reference characters indicate like parts as above, the valve assembly 10 is particularly useful for a sink 30 of cascade type having two bowls 31, 32 disposed adjacent each other so the water from one bowl 31 may overflow into the other bowl 32. As illustrated, the sink 30 has a cold water faucet 33 for delivering cold water into the first bowl 31 and a hot water faucet 34 for delivering hot water into the first bowl 31. The cold water outlet 14 of the valve assembly 10 connects to the cold water faucet 33 and the hot water outlet 15 of the valve assembly 10 connects to the hot water faucet 34.

As indicated, the button 24 is remote from the sink 30.

Instead of faucets 33, 34, the sink 30 may employ pre-rinse assemblies of conventional structure.

The invention thus provides a valve assembly that is able to automatically monitor the delivery of hot and cold water to a commercial sink.

The invention further provides a valve assembly that can be actuated remotely by a user without a need to be present at a sink thereby reducing the expense of preparing foods in a commercial kitchen.

The invention further provides a valve assembly that ensures that a consistently proper volume of water is dispensed for rinse purposes in a commercial kitchen while reducing the risk that hot water only would be supplied.

The invention further provides a valve assembly that can be retro-fit to existing kitchens and/or that can be provided on new installations without revision to existing faucet and pre-rinse assemblies.

The invention ensures quality and consistency of a rinse cycle through controlled time and water volume and ensures water conservation by eliminating waste due to the absence of personnel at a sink while water continues to flow.

What is claimed is:

1. A valve assembly comprising a housing having a cold water inlet, a hot water inlet, a cold water outlet in communication with said cold water inlet and a hot water outlet in communication with said hot water inlet;

a first normally closed solenoid valve in communication with said cold water outlet for closing off the flow of water therefrom;

a second normally closed solenoid valve in communication with said hot water outlet for closing off the flow of water therefrom;

a flow metering valve in communication with said cold water outlet for sensing a flow of cold water from said cold water outlet and delivering a signal in response to sensing of a flow rate below a minimum flow rate;

an electronic control module electrically connected to said first normally closed solenoid valve, said second normally closed solenoid valve and said metering valve; and a button electrically connected to said electronic control module, said button having an OFF position and an ON position and being manually movable from said OFF position to said ON position, said first normally closed solenoid valve being responsive to said button being moved from said OFF position to said ON position to allow a flow of water from said cold water outlet for a predetermined time period, said second normally closed solenoid valve being responsive to said button being moved from said OFF position to said ON position for said predetermined time period to allow a flow of water from said hot water outlet, and said electronic control module being responsive to said signal from said metering valve to deliver signals to each said solenoid valve to close and thereby block the flow of hot water and cold water.

2. A valve assembly as set forth in claim 1 wherein said second normally closed solenoid valve is responsive to said button being moved from said OFF position to said ON position a second time during said predetermined time period to block a flow of hot water from said hot water outlet.

3. A valve assembly as set forth in claim 1 further comprising a filter between said cold water inlet and said first normally closed solenoid valve for filtering cold water passing to said first solenoid valve.

4. A valve assembly as set forth in claim 1 further comprising a filter between said hot water inlet and said second normally closed solenoid valve for filtering hot water passing to said second solenoid valve.

5. In combination a sink having a cold water faucet for delivering cold water into said sink and a hot water faucet for delivering hot water into said sink;

a valve assembly for selectively delivering cold water to said cold water faucet and hot water to said hot water faucet, said valve assembly having a housing having a cold water inlet, a hot water inlet, a cold water outlet in communication with said cold water inlet and a hot water outlet in communication with said hot water inlet; a metering valve in communication with said cold water outlet for sensing a flow of cold water from said cold water outlet and delivering a signal in response to sensing of a flow rate below a minimum flow rate; a first normally closed solenoid valve in communication with said cold water outlet for closing off the flow of water therefrom; a second normally closed solenoid valve in communication with said hot water outlet for closing off the flow of water therefrom; and an electronic control module electrically connected to said metering valve, said first normally closed solenoid valve and said second normally closed solenoid valve; and a button electrically connected to said electronic control module, said button having an OFF position and an ON position and being manually movable from said OFF position to said ON position;

said first normally closed solenoid valve being responsive to said button being moved from said OFF position to said ON position to allow a flow of water from said cold water outlet for a predetermined time period;

said second normally closed solenoid valve being responsive to said button being moved from said OFF position to said ON position to allow a flow of water from said hot water outlet to said hot water faucet for said predetermined time period; and said electronic control module being responsive to said signal from said metering valve to deliver signals to each said solenoid valve to close and thereby block the flow of hot water and cold water.

6. The combination as set forth in claim 5 wherein said second normally closed solenoid valve is responsive to said button being moved from said OFF position to said ON position a second time during said predetermined time period to block a flow of hot water from said hot water outlet.

7. The combination as set forth in claim 5 wherein said sink has a first bowl for receiving water from each of said cold water faucet and said hot water faucet and a second bowl disposed in cascade relation to said first bowl for receiving an overflow of water therefrom.

8. The combination as set forth in claim 5 wherein said button is remote from said sink.

* * * * *